US007928826B1

(12) United States Patent
Woychik et al.

(10) Patent No.: US 7,928,826 B1
(45) Date of Patent: Apr. 19, 2011

(54) ELECTRICAL SWITCHING DEVICES USING A SHAPE MEMORY ALLOY (SMA) ACTUATION MECHANISM

(75) Inventors: Gerard A. Woychik, Shellsburg, IA (US); Susan M. Olson, Cedar Rapids, IA (US); Ryan J. Legge, Cedar Rapids, IA (US); Bryan S. McCoy, Cedar Rapids, IA (US)

(73) Assignee: Rockwell Collins, Inc., Cedar Rapids, IA (US)

( * ) Notice: Subject to any disclaimer, the term of this patent is extended or adjusted under 35 U.S.C. 154(b) by 883 days.

(21) Appl. No.: 11/499,104

(22) Filed: Aug. 4, 2006

(51) Int. Cl.
*H01H 71/18* (2006.01)
*H01H 37/46* (2006.01)
*H01H 37/04* (2006.01)
*F01B 29/10* (2006.01)

(52) U.S. Cl. ..... 337/140; 337/122; 337/139; 337/182

(58) Field of Classification Search ..... 337/140, 337/122, 139, 182
See application file for complete search history.

(56) References Cited

U.S. PATENT DOCUMENTS 1,741,601 A * 12/1929 Appelberg ..... 337/103
3,634,803 A * 1/1972 Willson et al. ..... 337/123
3,725,835 A * 4/1973 Hopkins et al. ..... 337/140
3,968,380 A * 7/1976 Jost et al. ..... 307/99
4,007,404 A * 2/1977 Jost et al. ..... 361/211
4,423,401 A * 12/1983 Mueller ..... 337/107
4,544,988 A * 10/1985 Hochstein ..... 361/211
4,551,975 A * 11/1985 Yamamoto et al. ..... 60/528
4,700,541 A * 10/1987 Gabriel et al. ..... 60/528
4,887,430 A * 12/1989 Kroll et al. ..... 60/527
5,061,914 A 10/1991 Busch et al.
5,410,290 A * 4/1995 Cho ..... 337/140
5,619,177 A 4/1997 Johnson et al.
5,684,448 A 11/1997 Jacobsen et al.
5,825,275 A 10/1998 Wuttig et al.
5,870,007 A 2/1999 Carr et al.
6,016,096 A 1/2000 Barnes et al. ..... 337/123
6,049,267 A 4/2000 Barnes et al. ..... 337/123
6,078,243 A 6/2000 Barnes et al. ..... 337/140
6,133,816 A 10/2000 Barnes et al. ..... 337/123
6,236,300 B1 5/2001 Minners
6,239,686 B1 * 5/2001 Eder et al. ..... 337/382
6,407,478 B1 6/2002 Wood et al.
6,516,146 B1 2/2003 Kosaka (Continued)

FOREIGN PATENT DOCUMENTS

JP 01262372 10/1989
JP 01262373 10/1989
WO WO 03/095798 11/2003

OTHER PUBLICATIONS

U.S. Appl. No. 11/903,666, filed Sep. 24, 2007, Cripe et al.
Office Action for U.S. Appl. No. 11/903,666, mail date Sep. 15, 2009, 12 pages.

(Continued)

*Primary Examiner* — Anatoly Vortman
(74) *Attorney, Agent, or Firm* — Matthew J. Evans; Daniel M. Barbieri

(57) ABSTRACT

An electrical switching device employs an actuator mechanism formed of a shape memory alloy (SMA). The electrical switching device includes a housing, at least one non-actuated electrical contact supported in the housing, and an actuator assembly contained within the housing. The actuator assembly includes a movable contact for engaging the non-actuated electrical contact and an actuator formed of a shape memory alloy (SMA). Application of a first electrical current to the actuator causes the actuator to move the movable contact to either engage or disengage the non-actuated electrical contact.

20 Claims, 6 Drawing Sheets

U.S. PATENT DOCUMENTS

| | | | | |
|---|---|---|---|---|
| 6,708,491 | B1 | 3/2004 | Weaver et al. | |
| 6,762,669 | B2 | 7/2004 | Alacqua et al. | |
| 6,917,276 | B1 | 7/2005 | Menard et al. | |
| 6,972,659 | B2 | 12/2005 | von Behrens et al. | |
| 6,981,374 | B2 | 1/2006 | Fairbanks et al. | |
| 7,036,312 | B2 | 5/2006 | Menard et al. | |
| 7,256,518 | B2 | 8/2007 | Gummins et al. | |
| 7,372,355 | B2 * | 5/2008 | Agronin et al. | 337/126 |
| 7,548,145 | B2 | 6/2009 | Rubel | |
| 2001/0010488 | A1 | 8/2001 | Minners | |
| 2002/0021053 | A1 | 2/2002 | Wood et al. | |
| 2002/0050881 | A1 | 5/2002 | Hyman et al. | |
| 2004/0211178 | A1 | 10/2004 | Menard et al. | |
| 2005/0146404 | A1 | 7/2005 | Yeatman | |
| 2006/0162331 | A1 | 7/2006 | Kirkpatirck et al. | |

OTHER PUBLICATIONS

International Search Report and Written Opinion for International Application No. PCT/US2008/073330, dated Mar. 6, 2009, 8 pages.

Loh, C S. et al. "Natural Heat-Sinking Control Method for High-Speed Actuation of the SMA," *Int'l Journal of Advanced Robotic Systems*, vol. 3, No. 4: 2006, pp. 303-312.

Response to Office Action in U.S. Appl. No. 11/903,666, filed with the U.S. Patent and Trademark Office on Oct. 29, 2009, 9 pages.

Office Action for U.S. Appl. No. 11/903,666, mail date Jan. 26, 2010, 11 pages.

Advisory Action for U.S. Appl. No. 11/903,666, mail date May 4, 2010, 8 pages.

U.S. Appl. No. 11/963,741, filed Dec. 21, 2007, Cripe et al.

U.S. Appl. No. 11/963,738, filed Dec. 21, 2007, Cripe et al.

* cited by examiner

ELECTRICAL SWITCHING DEVICES USING A SHAPE MEMORY ALLOY (SMA) ACTUATION MECHANISM

FIELD OF THE INVENTION

The present invention relates generally to the field of electrical switching devices, and more particularly to an electrical switching device having an actuator mechanism formed of a shape memory alloy (SMA).

BACKGROUND OF THE INVENTION

Shape memory alloys (SMA), such as nickel-titanium alloys, copper-aluminum-nickel alloys, copper-zinc-aluminum alloys, iron-manganese-silicon alloys, and the like, are metallic alloys that remember their geometry. After such alloys are deformed, they regain their original geometry by themselves during heating (one-way effect) or, at higher ambient temperatures, simply during unloading (pseudo-elasticity). This capability results from a temperature-dependent martensitic phase transformation from a low-symmetry martensite structure to a highly symmetric crystallographic austennite structure. In most shape memory alloys, a temperature change of only about 10° C. is necessary to initiate this phase change. The most common shape memory alloy, a nickel-titanium alloy, was first developed in 1962-1963 by the Naval Ordnance Laboratory, White Oak, Md., and commercialized under the trade name Nitinol (an acronym for Nickel Titanium Naval Ordnance Laboratories).

Electrical switching devices, in particular, vacuum tube electrical switching devices such as relays, switches, resettable fuses, and the like, typically employ electromechanical actuators or solenoids which are prone to failure. Complex avionic equipment often employs large numbers of such devices, thereby limiting the reliability of the equipment and aircraft. For example, high frequency (HF) antenna couplers used in aircraft communications systems employ vacuum relays for connecting the capacitors and inductors in the coupler during the tuning phase to create an appropriate impedance match to the antenna. Typical HF Antenna Couplers may employ many such relays (e.g., 30 or more). During manufacture, each relay must be carefully hand soldered and tested. Assemblies of the relays are then functionally tested. The failure of any relay in an assembly may require additional companion relays to be removed and replaced, the assembly to be reassembled, tuned and retested. In the event a vacuum relay fails in use either before or during flight of the aircraft, the HF antenna coupler must be removed from the aircraft and replaced, which may result in undesirable grounding of the aircraft. Thus, the failure of a single relay is undesirably expensive.

Consequently, it would be advantageous to provide electrical switching devices, including but not limited to, vacuum tube electrical switching devices such as relays, switches, resettable fuses, and the like, which employ actuator mechanisms formed of a shape memory alloy (SMA) for improved reliability and reduced cost.

SUMMARY OF THE INVENTION

Accordingly, the present invention is directed to an electrical switching device which employs an actuator mechanism formed of a shape memory alloy (SMA) for improved reliability and reduced cost.

In exemplary embodiments, the electrical switching device includes a housing, at least one non-actuated electrical contact supported in the housing, and an actuator assembly contained within the housing. The actuator assembly includes a movable contact for engaging the contact and an actuator formed of a shape memory alloy (SMA). Application of a first electrical current to the actuator causes the actuator to move the movable contact to either engage or disengage the non-actuated electrical contact for one of allowing or preventing the flow of a second electrical current through the contact.

It is to be understood that both the foregoing general description and the following detailed description are exemplary and explanatory only and are not necessarily restrictive of the invention as claimed. The accompanying drawings, which are incorporated in and constitute a part of the specification, illustrate an embodiment of the invention and together with the general description, serve to explain the principles of the invention.

BRIEF DESCRIPTION OF THE DRAWINGS

The numerous advantages of the present invention may be better understood by those skilled in the art by reference to the accompanying figures in which.

DETAILED DESCRIPTION OF THE INVENTION

Figure 1:
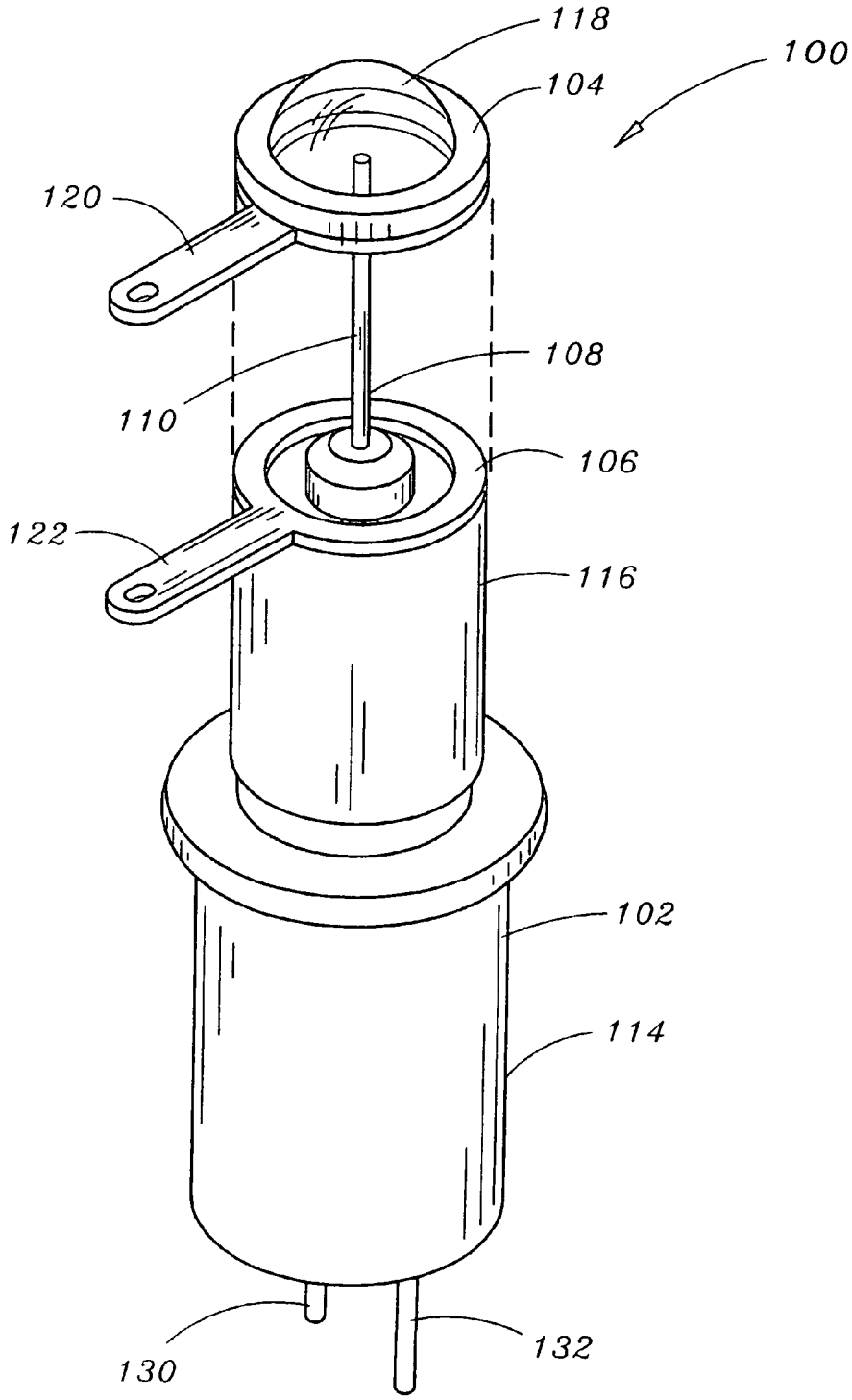
FIG. 1 is an isometric view illustrating an electrical switching device having a pivoting actuator assembly in accordance with an exemplary embodiment of the present invention, wherein the actuator mechanism is shown in a neutral or non-actuated position.

Reference will now be made in detail to the presently preferred embodiments of the invention, examples of which are illustrated in the accompanying drawings. It is to be appreciated that corresponding reference numbers refer to generally corresponding structures.

FIGS. 1 through 11 illustrate exemplary electrical switching devices, which employ actuator mechanisms formed of a shape memory alloy (SMA) in accordance with exemplary embodiments of the present invention. Each electrical switching device 100 illustrated comprises a housing 102 having one or more non-actuated electrical contacts 104 & 106 mounted in the housing 102. An actuator assembly 108 is supported within the housing 102. The actuator assembly 108 includes a movable contact 110 for engaging the non-actuated electrical contacts 104 & 106 to complete a circuit between the contacts 104 & 106 so that electrical current may flow between the contacts 104 & 106. The actuator assembly 108 moves the movable contact 110 between an actuated position, wherein the movable contact 110 engages the non-actuated electrical contacts 104 & 106 and a non-actuated position, wherein the movable contact 110 is disengaged from the contacts 104 & 106. In exemplary embodiments, the non-actuated contacts 104 & 106 and the movable contact 110 are formed of a conductive material such as copper, rhodium, a tungsten/molybdenum alloy, or the like.

The actuator assembly 108 includes an actuator 112 formed of a shape memory alloy (SMA) which changes shape upon the application of an electric current (e.g., when heated by the application of an electric current). In this manner, the application of an electrical current to the actuator 112 causes the actuator 112 to move the movable contact 110 to either engage or disengage the non-actuated electrical contacts 104 & 106 so that the flow of an electric current through the contacts 104 & 106 is either allowed or inhibited. In exemplary embodiments, the actuator 112 is formed of a nickel-titanium alloy such as Nitinol. However, it is contemplated that the particular shape memory alloy (SMA) used will depend on a variety of factors, such as the specific application in which the electrical switching device 100 is to be used. Thus, it is contemplated that other shape memory alloys may be used. Such shape memory alloys may include, but are not necessarily limited to, copper-aluminum-nickel alloys, copper-zinc-aluminum alloys, iron-manganese-silicon alloys, and the like. These shape memory alloys (SMA) may be used in place of nickel-titanium alloys in specific applications of the invention without departing from the scope and intent of the present invention. In exemplary embodiments, the actuator may employ a shape memory alloy (SMA) exhibiting a one-way shape memory effect. In such embodiments, the actuator 112, upon being heated by the application of an electric current, acquires a predetermined shape, geometry or length without the application of an external force. A return mechanism may be provided to return the actuator to its original position prior to heating. In exemplary embodiments, the return mechanism may be mechanical (e.g., spring 126), hydraulic, pneumatic, or the like. Alternatively, in other embodiments, the actuator 112 may employ a shape memory alloy (SMA) exhibiting a two-way shape memory effect, wherein the actuator 112 acquires two different shapes: one a low temperature shape when no electrical current is applied, and the other a high temperature shape acquired upon application of an electrical current. Additionally, it is contemplated that the specific metallurgical content of the shape memory alloys (SMA) employed may be varied to provide the electrical switching device 100 with specific performance characteristics (e.g., response time, contact force, fatigue life, or the like).

Figure 2:
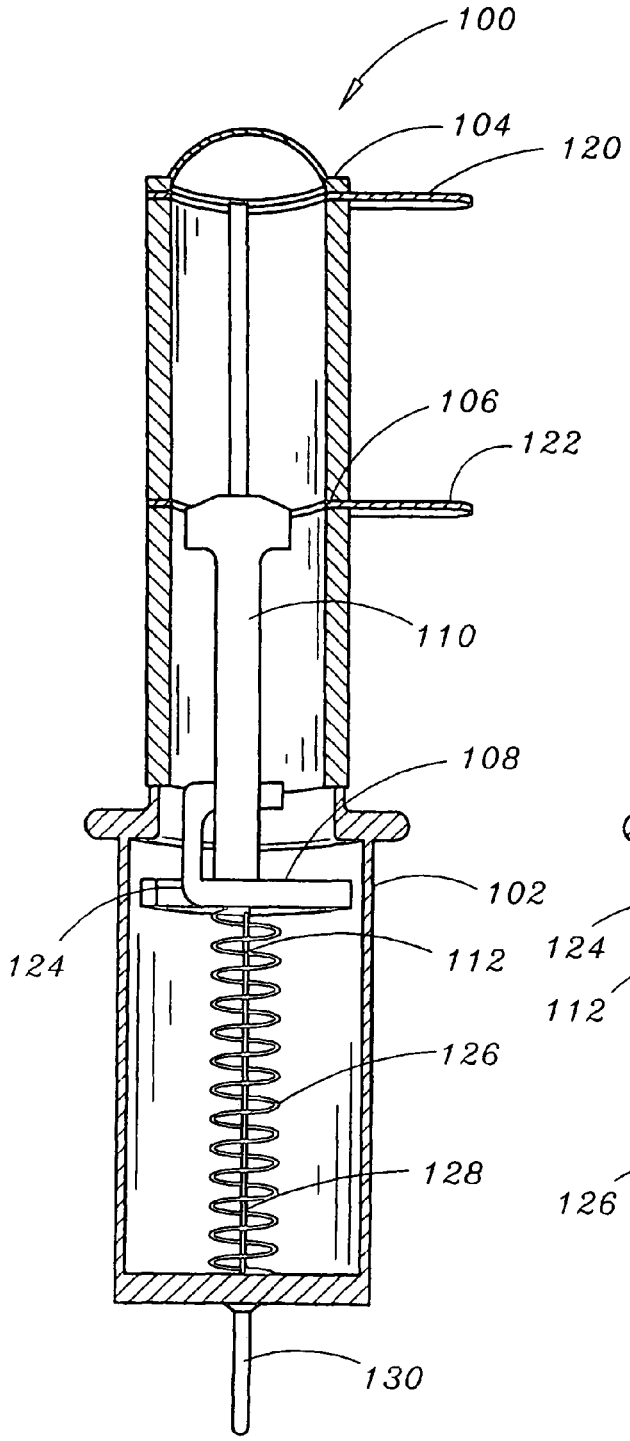
FIG. 2 is a cross-sectional side elevation view of the electrical switching device shown in FIG. 1, wherein the actuator assembly is shown in a non-actuated position.
Figure 3:
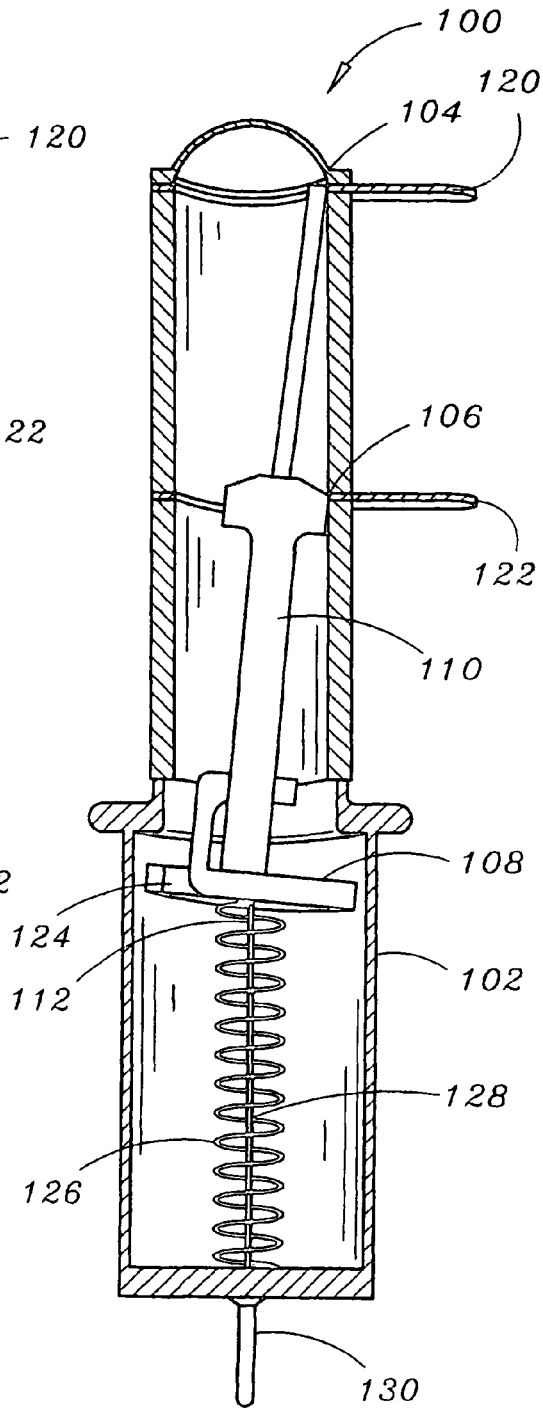
FIG. 3 is a cross-sectional side elevation view of the electrical switching device shown in FIGS. 1 and 2, wherein the actuator assembly is shown in an actuated position.

FIGS. 1, 2 and 3 illustrate a vacuum relay electrical switching device 100 having a pivoting actuator assembly 108 in accordance with an exemplary embodiment of the present invention. As shown, the electrical switching device 100 includes a vacuum tube housing 102 having a hollow metal case 114, a tubular insulator 116 formed of an electrically insulating material such as glass, a ceramic, or the like, coupled to the case 114, and a cap 118 coupled to the insulator 116 via a braze joint, or the like. In exemplary embodiments such as high-voltage RF applications and the like, the volume within the vacuum tube housing 102 (e.g., within cylindrical volume of the insulator 116) is at least partially evacuated to form a vacuum which functions as a dielectric. Alternatively, the volume within the vacuum tube housing 102 may be filled with a gas such as sulfur hexafluoride (SF6), air, or the like. In the embodiment illustrated, a first non-actuated contact 104 is supported in the insulator 116 of the housing 102 near the middle of the insulator 116. Similarly, a second non-actuated contact 106 is provided by the cap 118 of the insulator 116. Tabs 120 & 122 couple the non-actuated contacts 104 & 106 to external circuits.

In this embodiment, the actuator assembly 108 includes a flapper or diaphragm 124 supported in the case 114 of the housing 102 for supporting in the movable contact 110. A spring 126 (a coil spring is shown) extends between the bottom surface of the flapper 124 and the internal surface of the bottom of the case 114. As illustrated, the actuator 112 comprises a wire 128 formed of shape memory alloy (SMA) material extending between the bottom surface of the flapper 124 and the internal surface of the bottom of the case 114 within the spring 126. The wire 128 is electrically coupled to pins 130 & 132 mounted to the bottom of the case 114 and extending from the outer surface of the bottom of the case 114 so that an electric current may be applied to the wire 128.

The actuator assembly 108 is shown in the non-actuated state in FIG. 2. When an electric current is applied to the wire 128, as shown in FIG. 3, the wire 128 contracts and shortens, pivoting the flapper 124 downward and compressing the spring 126. The flapper 124 in turn pivots the movable contact 110 so that the movable contact 110 engages (makes physical contact with) the first and second non-actuated electrical contacts 104 & 106 completing a circuit between the first and second contacts 104 & 106 so that a second electric current may flow between the non-actuated contacts 104 & 106 through the movable contact 110.

When the first electric current is removed from the wire 128, contraction of the wire ceases so that the wire 128 is allowed to extend. The spring 126, being no longer compressed by the wire 128, extends and pivots the flapper 124 upward, which pivots the movable contact 110 to the non actuated position shown in FIG. 2. In this position, the movable contact no longer engages the first and second non-actuated electrical contacts 104 & 106 completing a circuit between the first and second contacts 104 & 106 opening the circuit so that flow of the second electric current between the contacts 104 & 106 is inhibited. It is contemplated that, in exemplary embodiments, the diameter (gauge) of the wire 128 and the shape memory alloy (SMA) material from which the wire is fabricated may be selected to achieve the relay performance attributes required by the application in which the vacuum relay electrical switching device 100 is used.

Figure 4:
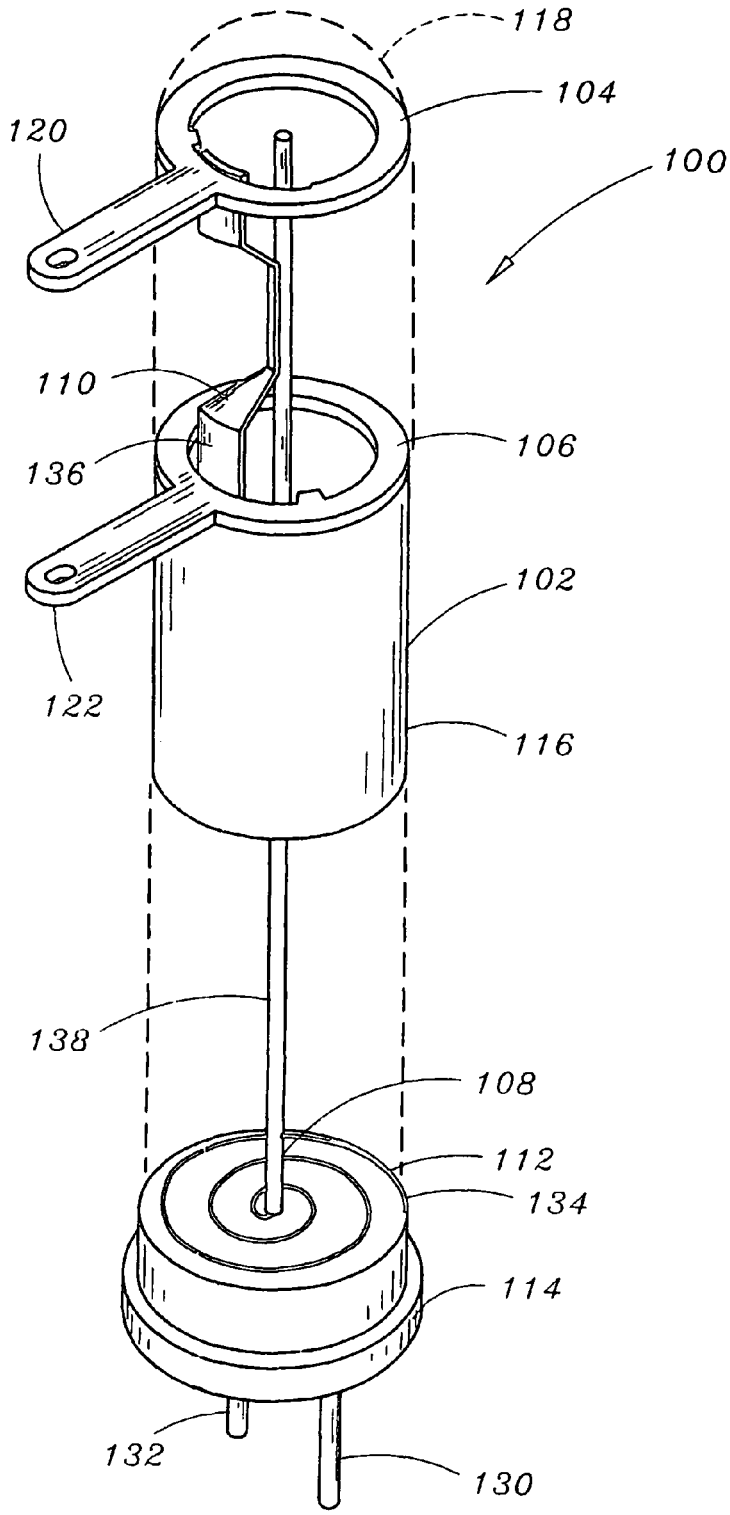
FIG. 4 is an isometric view illustrating a electrical switching device having a rotary actuator assembly in accordance with a second exemplary embodiment of the present invention.
Figure 5:
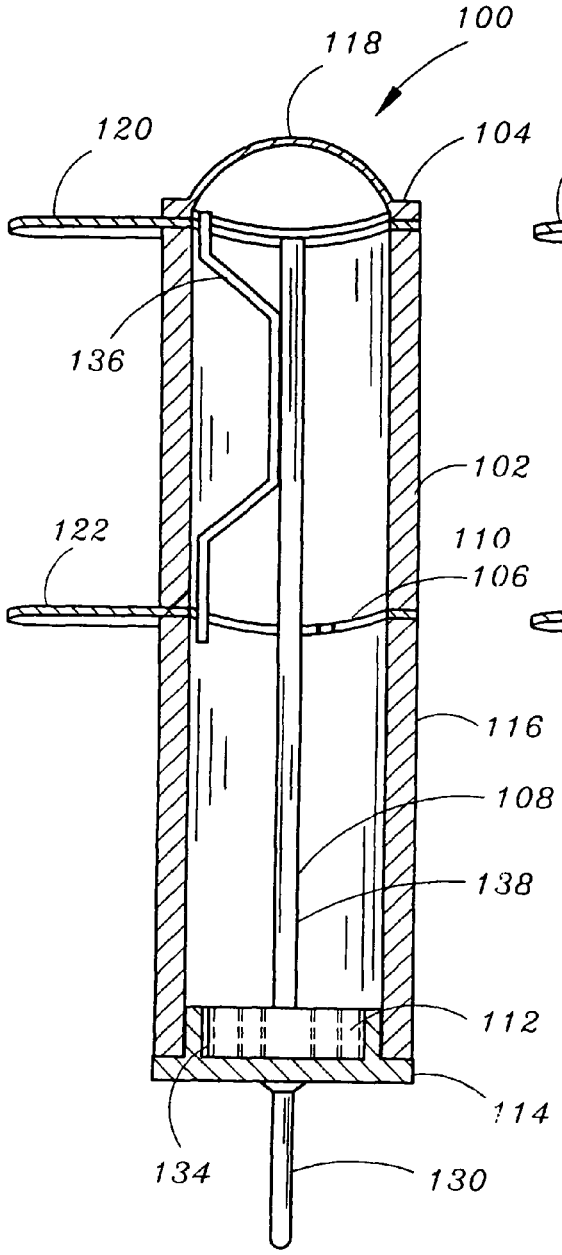
FIG. 5 is a cross-sectional side elevation view of the electrical switching device shown in FIG. 4, wherein the actuator assembly is shown in a non-actuated position.
Figure 6:
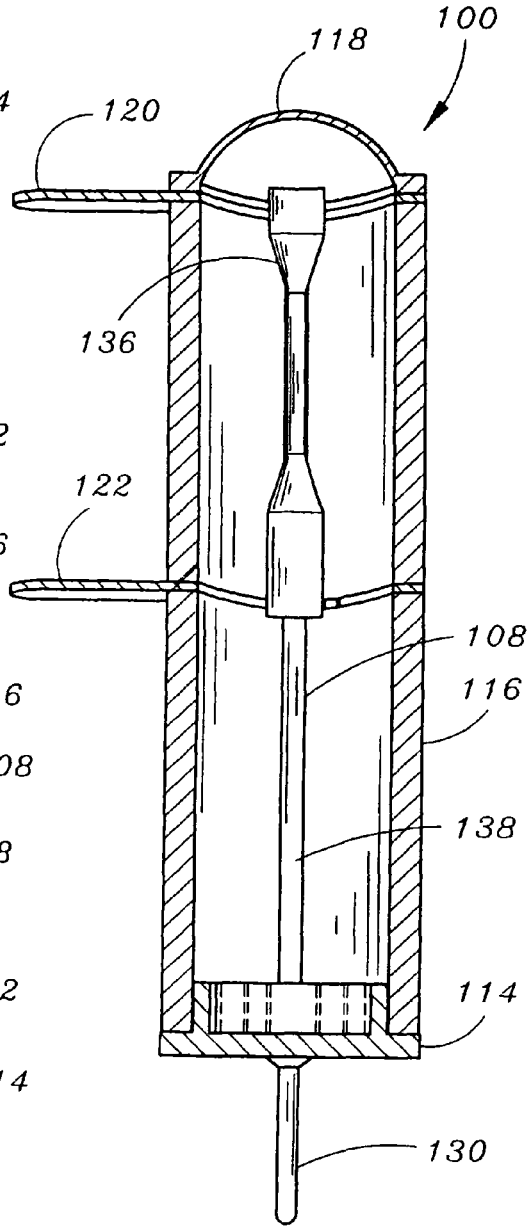
FIG. 6 is a cross-sectional side elevation view of the electrical switching device shown in FIGS. 4 and 5, wherein the actuator assembly is shown in an actuated position.

FIGS. 4, 5 and 6 illustrate a second vacuum relay electrical switching device 100 having a rotating actuator assembly 108 in accordance with an exemplary embodiment of the present invention. In this embodiment, the electrical switching device 100 again includes a vacuum tube housing 102 having a case 114, a tubular insulator 116 formed of an electrically insulating material such as glass, a ceramic, or the like, coupled to the case 114, and a cap 118 coupled to the insulator 116. The volume within the vacuum tube housing 102 (e.g., within insulator 116) may be at least partially evacuated to form a vacuum which functions as a dielectric. Alternatively, the volume within the vacuum tube housing may be filled with a gas such as sulfur hexafluoride (SF6), air, or the like. As in the embodiment shown in FIGS. 1, 2 and 3, a first non-actuated contact 104 is provided by the cap 118 of the insulator 116, while a second non-actuated contact 106 is supported in the insulator 116 of the housing 102 near the middle of the insulator 116. Tabs 120 & 122 couple the non-actuated contacts 104 & 106 to external circuits.

In this embodiment, the actuator 112 comprises a coil or spiral 134 formed of shape memory alloy (SMA) material. The movable contact 110 comprises a rotor 136 coupled to the coil 134 via a shaft 138 which wipes non-actuated contacts 104 & 106 when rotated. The coil 136 is electrically coupled to pins 130 & 132 mounted to the bottom of the case 114 and extending from the outer surface of the bottom of the case 114.

When an electric current is applied to the coil 134, as shown in FIG. 5, the coil 134 contracts, tightening, and rotating the shaft 138 which in turn rotates the rotor 136 (e.g., in a clockwise direction) so that the rotor 136 engages the first and second non-actuated electrical contacts 104 & 106 completing a circuit between the contacts 104 & 106 so that a second electric current may flow between the non-actuated contacts 104 & 106 through the movable contact 110. When the first electric current is removed from the coil 134, the contraction of the coil 134 ceases so that the coil 134 uncoils rotating the shaft 136 in the direction opposite the direction the shaft 138 was rotated when the electric current was applied (e.g., the counterclockwise direction). The shaft 138 in turn rotates the rotor 136 to the non actuated position shown in FIG. 6 so that the rotor 136 no longer engages the first and second non-actuated electrical contacts 104 & 106 opening the circuit so that flow of the second electric current between the contacts 104 & 106 is inhibited. As in the embodiment shown in FIGS. 1, 2 and 3, it is contemplated that the shape memory alloy (SMA) material from which the coil 134 is fabricated may be selected to achieve the specific response required by the application in which the vacuum relay electrical switching device 100 is used.

Figures 7, 8, 9:
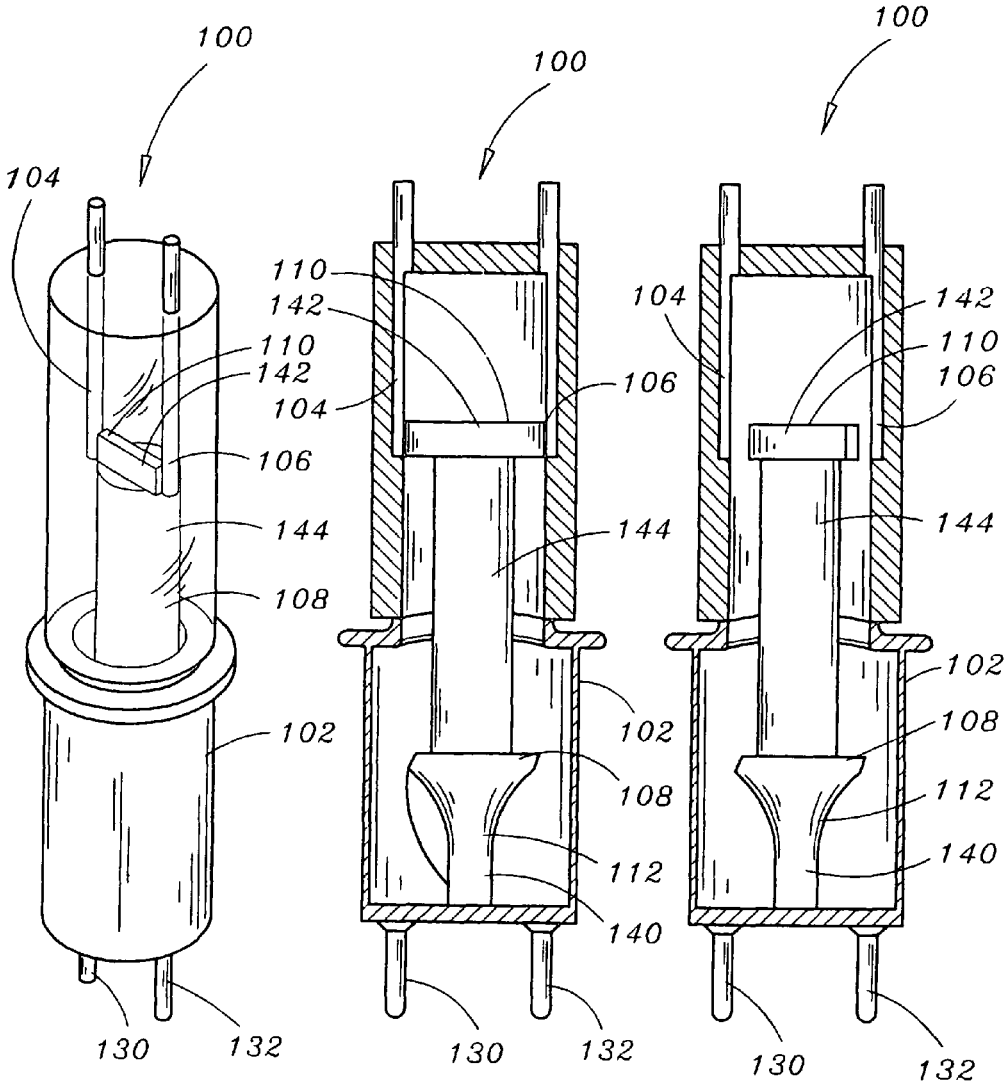
FIG. 7 is an isometric view illustrating a electrical switching device having a rotary actuator assembly in accordance with a third exemplary embodiment of the present invention.
FIG. 8 is a cross-sectional side elevation view of the electrical switching device shown in FIG. 7, wherein the actuator assembly is shown in a non-actuated position.
FIG. 9 is a cross-sectional side elevation view of the electrical switching device shown in FIGS. 7 and 8, wherein the actuator assembly is shown in an actuated position.

FIGS. 7, 8 and 9 illustrate a third vacuum relay electrical switching device 100 having a rotating actuator assembly 108 in accordance with an alternative exemplary embodiment of the present invention. The electrical switching device 100 includes a vacuum tube housing 102 having a case or base 114 and an insulator 116 formed of an insulating material such as glass, a ceramic, or the like, coupled to the case 114. The volume within the vacuum tube housing 108 (e.g., within insulator 116) may be at least partially evacuated to form a vacuum which functions as a dielectric. Alternatively, the volume within the vacuum tube housing may be filled with a gas such as sulfur hexafluoride (SF6), air, or the like. First and second non-actuated contacts 104 & 106 extend through the top of the insulator 116 of the housing 102 and along the sides of the insulator 116.

In this embodiment, the actuator 112 comprises shaped block 140 formed of shape memory alloy (SMA) material having a generally funnel shaped cross-section. The movable contact 112 comprises a bar 142 coupled to the shaped block 140 via a shaft 144 so that the bar 142 engages or wipes the non-actuated contacts 104 & 106 when rotated. The shaped block 140 is electrically coupled to pins 130 & 132 extending from the outer surface of the bottom of the case 114 so that an electric current may be applied to the block 140. When the electric current is applied to the shaped block 140, as shown in FIG. 8, the block 140 twists, rotating the shaft 144 which in turn rotates the bar 142 (e.g., in a clockwise direction) so that it engages the first and second electrical contacts 104 & 106, completing a circuit between the first and second contacts 104 & 106 allowing a second electric current to flow through the contacts 104 & 106.

When the first electric current is removed from the shaped block 140, the twist of the block ceases so that the block 140 untwists, rotating the shaft 144 in the opposite (e.g., counterclockwise) direction. The shaft 144 in turn rotates the bar 142 to the non-actuated position shown in FIG. 9. In this position, the bar 142 no longer engages the first and second non-actuated electrical contacts 104 & 106 opening the circuit so that flow of the second electric current between the contacts 104 & 106 is inhibited.

As in the embodiments illustrated in FIGS. 1 through 6, it is contemplated that the shape memory alloy (SMA) material from which the shaped block 140 of the present embodiment is fabricated may be selected to achieve the specific response required by the application in which the vacuum relay electrical switching device 100 is used. For example, in one specific embodiment, the shaped block 140 may be formed of Nitinol exhibiting a two-way memory effect, and configured to contract approximately 7% when an electrical current impulse of 3V at 10 mA (nominal) is applied thereby causing the block 140 to twist due to its shape. However, it is contemplated that the shaped block 140 may alternatively be formed of other shape memory alloy (SMA) materials, including shape memory alloy (SMA) materials exhibiting a one-way shape memory effect, or the like, without departing from the scope and intent of the present invention.

Figure 10:
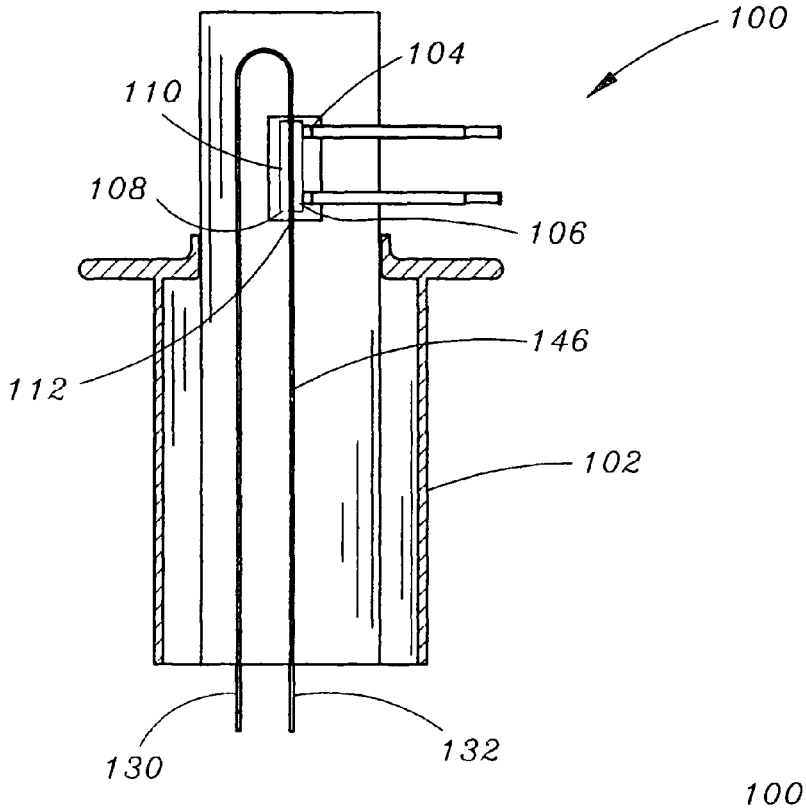
FIG. 10 is a cross-sectional side elevation view illustrating a electrical switching device having an actuator assembly including a filament actuator in accordance with a fourth exemplary embodiment of the present invention.
Figure 11:
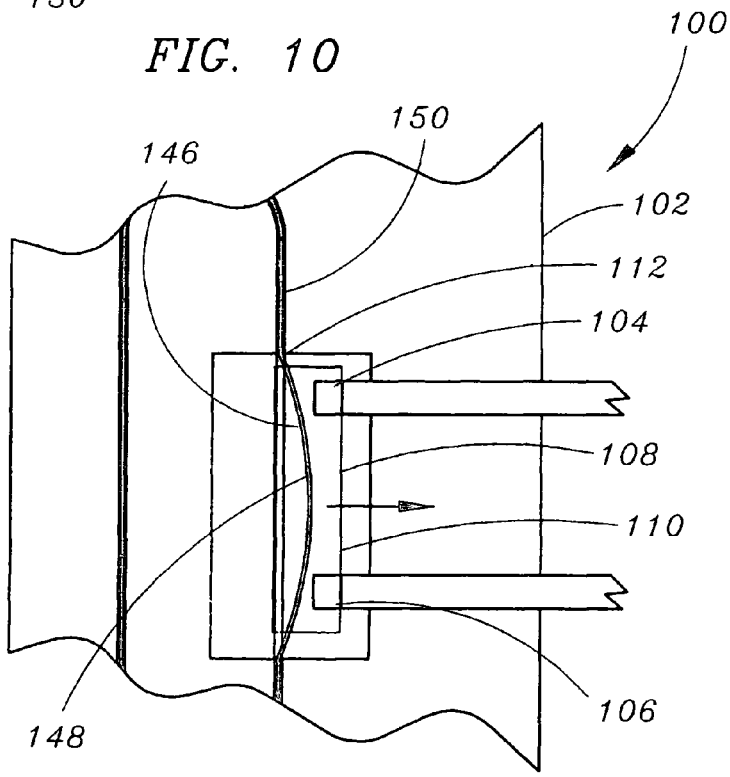
FIG. 11 is a partial cross-sectional side elevation view of the electrical switching device shown in FIG. 10, further illustrating linear movement of the movable contact assembly by the actuator.

FIGS. 10 and 11 illustrate an electrical switching device 100 having an actuator assembly 112 including a filament actuator in accordance with a fourth exemplary embodiment of the present invention. As shown, the electrical switching device 100 includes a vacuum tube housing 102 having a hollow metal case 114 and an insulator 116 formed of an insulating material such as glass, a ceramic, or the like, coupled to the case 114. The volume within the vacuum tube housing 108 (e.g., within insulator 116) is at least partially evacuated to form a vacuum which functions as a dielectric. Alternatively, the volume within the vacuum tube housing may be filled with a gas such as sulfur hexafluoride (SF6), air, or the like. Non-actuated electrical contacts 104 & 106 are supported in the insulator 116 of the housing 102.

In this embodiment, the actuator 112 comprises a filament 146 of shape memory alloy (SMA) material having two control leads or pins 130 & 132 extending from the outer surface of the bottom of the case 114. As shown, all but a section 148 of the filament 146 is held (e.g., encased within a sleeve 150, or the like) which prevents movement of the filament 146. The section 150 not held within the sleeve is surrounded by movable contact 110, which is allowed to slide between a first position, wherein the movable contact 110 does not engage the non-actuated contacts 104 & 106 and a second position wherein the movable contact 110 engages the non-actuated electrical contacts 104 & 106. When an electric current is applied to the filament 146, the filament 146 contracts allowing the movable contact 110 to disengage the non-actuated contacts. When the first electric current is removed from the filament 146, the contraction of the filament 146 ceases so that the filament 146 is allowed to lengthen. As the filament lengthens, the exposed section 150 of filament 146 bows outward, as shown in FIG. 11, so that the movable contact 110 engages the non-actuated electrical contacts 104 & 106 completing a circuit between the contacts 104 & 106 as shown, or alternately, if the filament 146 is instead allowed to bow away from the contacts 104 & 106, opening the circuit so that flow of the second electric current between the non-actuated electrical contacts 104 & 106 is inhibited.

It is contemplated that, in exemplary embodiments, the diameter (gauge) of the filament 146 and the shape memory alloy (SMA) material from which the filament 146 is fabricated may be selected to achieve the specific response required by the application in which the vacuum relay electrical switching device 100 is used. The filament 146 may exhibit either one-way or two-way shape memory effect. If a filament 146 exhibiting one-way shape memory effect is employed, a return mechanism such as a mechanical device (e.g., a spring assembly), a hydraulic device, a pneumatic device, or the like, may be utilized to bias the movable contact 110 to either the opened (non-engaged) or closed (engaged) positions.

In exemplary embodiments, the electrical switching devices 100 illustrated may comprise vacuum tube electrical devices such as vacuum relays, switches, resettable fuses, or the like which employ a vacuum tube housing 102. However, it is contemplated that electrical switching devices 100 in accordance with the present invention need not be limited to such embodiments. Further, in the embodiments illustrated, single pole, single throw (SPST) relays are shown for purposes of illustration, however it is contemplated that double pole and/or double throw relays (e.g., SPDT, DPDT, etc.) or even multiple pole, multiple throw relays may also be implemented without departing from the scope and intent of the present invention, for example, by modifying the configuration of the contacts being used.

Accordingly, it is believed that the present invention and many of its attendant advantages will be understood by the forgoing description. It is also believed that it will be apparent that various changes may be made in the form, construction and arrangement of the components thereof without departing from the scope and spirit of the invention or without sacrificing all of its material advantages. The form herein before described being merely an explanatory embodiment thereof. It is the intention of the following claims to encompass and include such changes.

What is claimed is:

1. A circuit, comprising:

a high frequency antenna coupler for an aircraft communication system, comprising an electrical switching device, comprising:

a vacuum tube housing;

a first non-actuated contact supported in the housing;

a second non-actuated contact supported in the housing; and an actuator assembly contained within the housing, the actuator assembly including a movable contact for engaging the first non-actuated contact and the second non-actuated contact and an actuator formed of shape memory alloy (SMA);

wherein application of a first electric current to the actuator causes the actuator to move the movable contact to one of engage or disengage the first and second non-actuated contacts so as to one of complete or open a circuit between the first and second non-actuated contacts, respectively.

2. The circuit as claimed in claim 1, wherein the shape memory alloy (SMA) comprises a one-way shape memory alloy (SMA), and the actuator further comprises a return mechanism moving the movable contact to one of disengage or engage the non-actuated contact.

3. The circuit as claimed in claim 1, wherein the actuator assembly further comprises a flapper pivotally mounted in the housing for supporting the movable contact and a spring for coupling to the flapper and the housing.

4. The circuit as claimed in claim 3, wherein the actuator further comprises a wire extending between the housing and the flapper, the wire contracting when the first electric current is applied for pivoting the flapper and causing the movable contact to engage the non-actuated electrical contact.

5. The circuit of claim 1, wherein the housing comprises a cylindrical portion coupled to the first and second non-actuated contacts, wherein the moveable contact comprises an elongated portion which in an engaged position makes contact with the first and second non-actuated contacts at first and second surfaces of the elongated portion.

6. The circuit of claim 1, wherein the shape memory alloy comprises Nitinol.

7. The circuit of claim 1, wherein the actuator assembly further comprises a diaphragm pivotally mounted in the housing for supporting the movable contact and a spring coupled to the diaphragm and to an internal surface of the housing, wherein the actuator further comprises a wire extending between the internal surface of the housing and the flapper, the wire contracting when the first electric current is applied for pivoting the flapper and causing the movable contact to engage the non-actuated electrical contact.

8. The circuit of claim 7, wherein the housing is cylindrical having a flat surface, wherein the internal surface of the housing is the flat surface.

9. The circuit of claim 8, wherein the wire is disposed within coils of the spring.

10. The circuit of claim 3, wherein the movable contact comprises an elongated portion, wherein a first end of the elongated portion engages the first non-actuated contact and a middle portion of the elongated portion engages the second non-actuated contact.

11. The circuit of claim 9, further comprising first and second control leads coupled to the wire and extending from an outer surface opposite the internal surface.

12. An electrical switching device, comprising:

a vacuum tube housing;

a first non-actuated electrical contact supported in the housing; and a second non-actuated electrical contact supported in the housing;

an actuator assembly contained within the housing, the actuator assembly including a movable contact for engaging the first non-actuated electrical contact and the second non-actuated electrical contact and an actuator formed of shape memory alloy (SMA);

wherein application of a first electrical current to the actuator causes the actuator to move the movable contact to one of engage or disengage the first non-actuated electrical contact and the second non-actuated electrical contact so as to one of complete or open a circuit between the first and second non-actuated electrical contacts, wherein the actuator assembly further comprises a diaphragm or flapper pivotally mounted in the housing for supporting the movable contact and a spring coupled to the diaphragm and to an internal surface of the housing, wherein the actuator further comprises a wire extending between the internal surface of the housing and the diaphragm or flapper, the wire contracting when the first electric current is applied for pivoting the diaphragm or flapper and causing the movable contact to engage the non-actuated electrical contact.

13. The electrical switching device as claimed in claim 12, wherein the shape memory alloy (SMA) comprises a one-way shape memory alloy (SMA).

14. The electrical switching device as claimed in claim 12, wherein the actuator further comprises a return mechanism moving the movable contact to one of disengage or engage the non-actuated contact.

15. The electrical switching device as claimed in claim 12, wherein the shape memory alloy (SMA) comprises at least one of a nickel-titanium alloy, a copper-aluminum-nickel alloy, a copper-zinc-aluminum alloy or an iron-manganese-silicon alloy.

16. The circuit of claim 12, wherein the housing is cylindrical having a flat surface, wherein the internal surface of the housing is the flat surface.

17. The circuit of claim 16, wherein the movable contact comprises an elongated portion, wherein a first end of the elongated portion engages the first non-actuated contact and a middle portion of the elongated portion engages the second non-actuated contact.

18. The circuit of claim 17, wherein the wire is disposed within coils of the spring.

19. The circuit of claim 18, further comprising first and second control leads coupled to the wire and extending from an outer surface opposite the internal surface.

20. A circuit, comprising:

a high frequency antenna coupler for an aircraft communication system, comprising:

an electrical switching device, comprising:

a vacuum tube housing;

a first non-actuated electrical contact supported in the housing;

a movable contact contained within the housing; and means, formed of shape memory alloy (SMA), for moving the movable contact between a first position and a second position;

wherein application of an electrical current to the contact moving means moves the movable contact to complete or open a circuit between the first non-actuated electrical contact and a second non-actuated electrical contact.

* * * * *